United States Patent [19]

Gouraige, Jr.

[11] 4,199,145

[45] Apr. 22, 1980

[54] DENTAL BOARD GAME APPARATUS

[76] Inventor: Frantz Gouraige, Jr., 531 E. Lincoln Ave., Apt. 2G, Mount Vernon, N.Y. 10552

[21] Appl. No.: 925,732

[22] Filed: Jul. 18, 1978

[51] Int. Cl.[2] ..... A63F 3/00

[52] U.S. Cl. ..... 273/248; 273/288; 35/1

[58] Field of Search ..... 273/258, 261, 262, 248, 273/236

[56] References Cited

U.S. PATENT DOCUMENTS

| | | | |
|---|---|---|---|
| 526,373 | 11/1894 | Boyer | 273/258 |
| 2,756,053 | 7/1956 | Wales | 273/258 |
| 2,799,504 | 7/1957 | Keyko | 273/262 |
| 3,065,969 | 11/1962 | Jennens | 273/258 |

*Primary Examiner*—Richard C. Pinkham

*Attorney, Agent, or Firm*—Allison C. Collard; Thomas M. Galgano

[57] ABSTRACT

A dental board game apparatus is provided which includes a board having a playing field, defined by an array of contiguous playing spaces, having a generally arched-shaped upper and lower periphery, the upper periphery of which is bounded by two first sets of eight playing spaces which collectively define the upper left and right quadrants, respectively, of the upper ridge of the mouth and individually define the respective location of an upper tooth of the mouth, and the lower periphery of which is bounded by two second sets of eight playing spaces which collectively define the lower left and right quadrants, respectively, of the lower ridge of the mouth and individually define the respective location of a lower tooth of the mouth. The apparatus also includes two first groups of eight playing pieces, the playing pieces of each group of which each represent a specific upper tooth of the upper left and upper right quadrants of the mouth, respectively, and two second groups of eight playing pieces, the playing pieces of each group of which each represent a specific lower tooth of the lower left and right quadrants of the mouth, respectively. The playing pieces are randomly movable along the playing spaces for desired eventual placement on its respective end space.

8 Claims, 8 Drawing Figures

DENTAL BOARD GAME APPARATUS

The present invention relates to a board game apparatus. More particularly, it relates to a dental board game apparatus.

Board and parlor games are, of course, well-known and widely used, both for entertainment as well as educational purposes. However, so far as it is known, no presently-available board game deals specifically with the field of dentistry and which, aside from its entertainment value, can be used as an aid in learning the anatomy of the mouth and the names and positions of the various teeth of the mouth.

Accordingly, it is an object of the present invention to provide a novel dental board game apparatus.

It is also an object of the present invention to provide such a novel board game apparatus which is both entertaining as well as educational.

It is a further object of the present invention to provide such a novel board game which is relatively easy and simple to play and which may be economically fabricated.

It is a more particular object of the present invention to provide such a novel board game apparatus having the foregoing attributes and characteristics which permits the players to become readily acquainted with dental terminology.

Certain of the foregoing and related objects are readily achieved in a dental board game apparatus which is intended for at least two players and which includes a board having a playing field defined by an array of contiguous playing spaces. The board has a generally arched-shaped upper and lower periphery, the upper periphery of which is bounded by two first sets of eight playing spaces which collectively define the upper left and upper right quadrants, respectively, of the upper ridge of the mouth and individually define the respective location of an upper tooth of the mouth. The lower periphery of the board is bounded by two second sets of eight playing spaces which collectively define the lower left and right quadrants, respectively, of the lower ridge of the mouth and individually define the respective location of a lower tooth of a mouth. The apparatus also includes two first groups of eight playing pieces, the playing pieces of each group of which each represent a specific upper tooth of the upper left and upper right quadrants of the mouth, respectively, and two second groups of eight playing pieces, the playing pieces of each group of which each represent a specific lower tooth of the lower left and right quadrants of the mouth, respectively. Each of the playing pieces is initially positionable on a starting playing space remote from the playing space of the first and second sets which defines the respective location of the tooth which the playing piece represents and also the end space for the playing piece. The playing pieces are thereafter randomly movable along the playing spaces for desired eventual placement on its respective end space.

Preferably, the board additionally includes four discrete groups of eight contiguous starting spaces disposed outwardly of the periphery of the playing field, the starting spaces of the first, second, third, and fourth groups of which each represent a starting space for one of the playing spaces representing a specific tooth in the upper left, upper right, lower left, and lower right quadrants of the mouth, respectively. At least one of the spaces of the first, second, third, and four groups of starting spaces adjoin at least one of the playing spaces defining the lower right, lower left, upper right, and upper left quadrant of the mouth, respectively.

Most advantageously, the playing field additionally includes two third sets of seven playing spaces, the playing spaces of one set of which each adjoin at least one of the playing spaces of one of the first sets of playing spaces which define the upper right quadrant of the upper ridge and the playing spaces of the other set of which each adjoin at least one of the playing spaces of the other of the first sets of playing spaces which define the upper left quadrant of the upper ridge; the two third sets of spaces collectively defining the palatal surface of the mouth. Similarly, two fourth sets of seven playing spaces are provided, the playing spaces of one set of which each adjoin at least one of the playing spaces of one of the second sets of playing spaces which define the lower right quadrant of the lower ridge and the playing spaces of the other set of which each adjoin at least one of the playing spaces of the other of the second sets of playing spaces which define the lower left quadrant of the lower ridge; the two fourth sets collectively defining the lingual surface of the mouth. The playing spaces of "one" and the "other" of the third sets each represent a restarting location for one of the playing pieces of the second groups of playing pieces representing a specific tooth of the lower left and right quadrants of the mouth, respectively, and the playing spaces of the "one" and the "other" of the fourth sets each represent a restarting location for one of the playing pieces of the first groups of playing pieces representing the upper left and right quadrant of the mouth, respectively.

Most desirably, the playing field has a generally hexagonal periphery each of the playing spaces is hexagonal in shape and comprise a total of 226 spaces. The apparatus also advantageously includes a die for determining who proceeds initially.

In a preferred embodiment, the two first and second groups of playing pieces, each comprise eight tokens each of which is configured to simulate the central, lateral, cuspid, first bicuspid, second bicuspid, first molar, second molar, and third molar teeth of the mouth, respectively, and which is mounted on a base colored differently from the bases of the teeth of the other sets. It is also preferable that the starting spaces, restarting spaces and spaces associated with a particular group are colored the same as the bases of such associated playing spaces. Most advantageously, each group of playing pieces are labelled 1 to 8, each set of starting spaces are labelled 1 to 8, each set of restarting spaces are labelled 2 to 8 and each set of end spaces are labelled 1 to 8.

Other objects and features of the present invention will become apparent from the following detailed description when taken in connection with the accompanying drawings which disclose one embodiment of the invention. It is to be understood that the drawings are designed for the purposes of illustration only and is not intended as a definition of the limits and scope of the invention disclosed.

In the drawing, wherein similar reference numerals denote similar elements throughout the several views.

Figure 1:
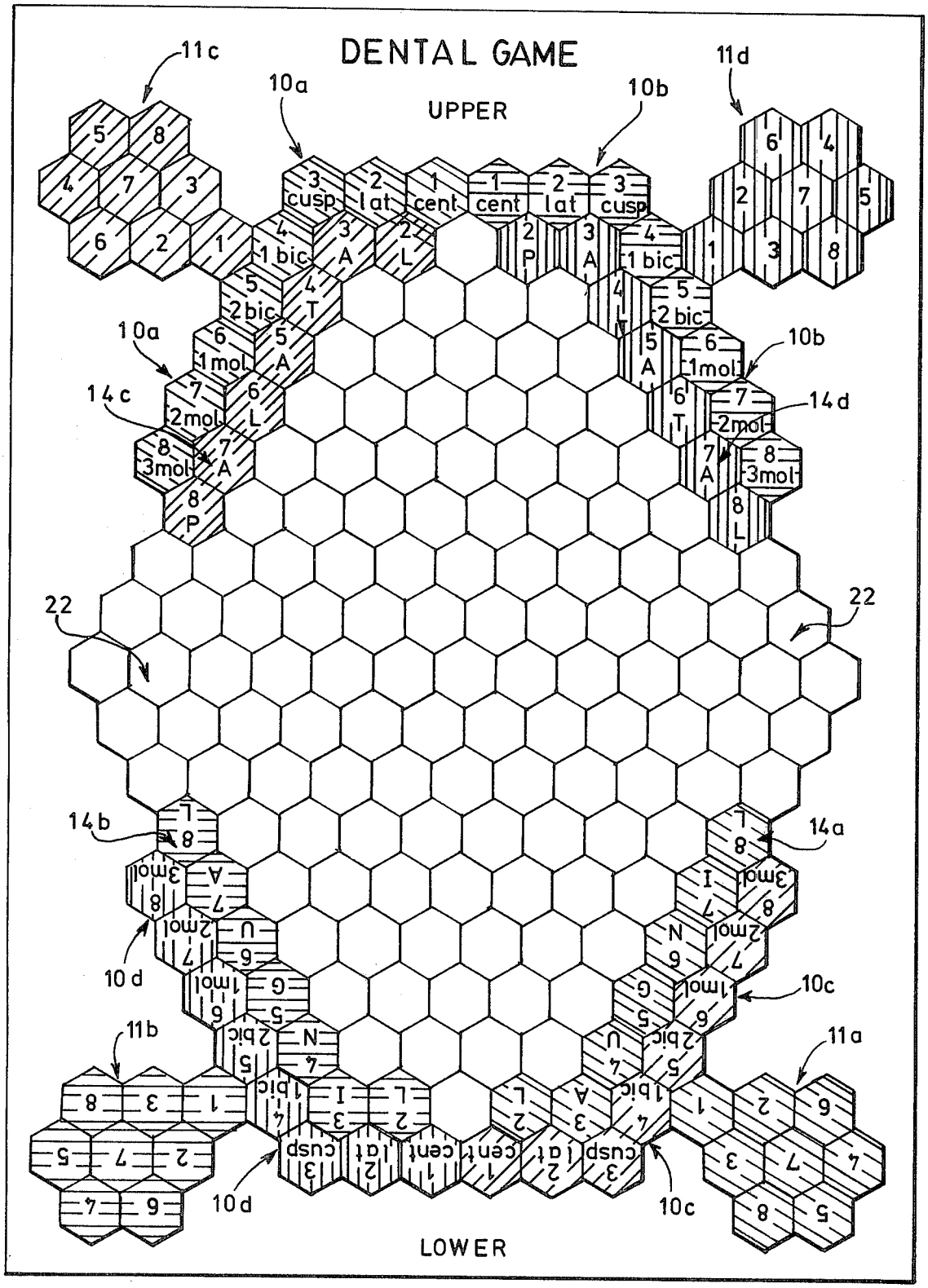
FIG. 1 is a plan view of a game board used in the novel game board apparatus embodying the present invention.

Turning now in detail to the drawings and, in particular, FIG. 1 thereof, therein illustrated is a game board of the present invention, generally designated by the numeral 20, having a generally hexagonal playing field 22, defined by an array of a total of 226 contiguous, hexagonal playing spaces. The playing field has a generally arch-shaped upper and lower periphery which generally corresponds to the shape of the upper and lower ridges or arches of the mouth as they are illustrated in "open mouth" tooth diagrams of the type commonly used in the dentistry art.

The upper periphery of the playing field is bounded by two sets of eight adjoining playing spaces 10*a* and 10*b* colored green and blue, respectively, which collectively define the right and left quadrants of the upper ridge of the mouth, respectively, and individually define a respective location of an upper tooth of the mouth. The spaces of sets 10*a* and 10*b* are each labelled 1 to 8 since each quadrant of the mouth contains eight teeth, and each have imprinted thereon an abbreviation of the name of the tooth which is located at the respective space; i.e., cent. for "central," lat. for "lateral," 1-bic. for "1st bicuspid," 2-bic for "2nd bicuspid," 1-mol for "1st molar," 2-mol for "2nd molar," and 3-mol for "3rd molar or wisdom tooth."

Similarly, the lower periphery of the playing field is bounded by two sets of eight adjoining playing spaces 10*c* and 10*d* (colored brown and red, respectively) which collectively define the left and right quadrants of the lower ridge of the mouth, respectively, and individually define a respective location of a lower tooth of the mouth. The spaces of sets 10*c* and 10*d* are correspondingly numbered and labelled as sets 10*a* and 10*b*.

As shown in FIG. 3–6, four sets of eight playing pieces or tokens 12*a*, 12*b*, 12*c*, and 12*d* are provided, each of which are configured to simulate a specific tooth of the mouth. The bases of the playing spaces of each set 12*a*, 12*b*, 12*c*, and 12*d* are each colored and numbered the same as the spaces of sets 10*a*, 10*b*, 10*c*, and 10*d*, respectively, so as to permit ready identification of their proper positioning. In addition, the upper surfaces of tokens 1, 4, 5 of each set 12*a*, 12*b*, 12*c*, and 12*d* are each provided with a corresponding colored dot 15*a*, 15*b*, 15*c*, 15*d*, the purpose for which will be described in greater detail hereinafter.

The playing field also includes four discrete groups of starting spaces, 11*a*, 11*b*, 11*c*, and 11*d*, one at each corner of the playing field 22, disposed outwardly of the upper and lower, hexagonally-shaped field periphery, the spaces of each set of which are colored the same as the spaces of sets 10*a*, 10*b*, 10*c*, and 10*d*, respectively, and the bases of the tokens of sets 12*a*, 12*b*, 12*c*, and 12*d*, respectively. The starting spaces of each group 11*a*, 11*b*, 11*c*, and 11*d* are also numbered 1 to 8 and each define the starting location for the corresponding number and colored token of sets 12*a*, 12*b*, 12*c*, and 12*d*, respectively. Space 1 of each of the four sets 11*a*, 11*b*, 11*c*, and 11*d* adjoin spaces 4 and 5 of the sets 10*c*, 10*d*, 10*a*, and 10*b*, respectively.

Also included on the playing field are four sets of seven restarting spaces 14*a*, 14*b*, 14*c*, and 14*d*, the spaces of each set of which are also colored the same as the spaces of sets 10*a*, 10*b*, 10*c*, and 10*d* and the bases of tokens 12*a*, 12*b*, 12*c*, and 12*d*. The spaces of sets 14*a* and 14*b* each adjoin one of the spaces of sets 10*c* and 10*d*, respectively, and collectively represent the lingual surface of the mouth (i.e., the interior area where the tongue contacts the teeth or tissues near the teeth). Correspondingly, the spaces of sets 14*c* and 14*d* each adjoin one of the spaces of sets 10*a* and 10*b*, respectively, and collectively represent the palatal surface of the mouth (i.e., the interior of the upper jaw or roof of the mouth). Each of the sets 14*a*, 14*b*, 14*c*, and 14*d* are numbered 2 to 8 and represent the restarting spaces for the similarly numbered token of the same colored set (as will also be described in greater detail hereinafter).

The game is intended to be played by either two or four players. In the case of two players, one player controls one set of playing pieces 12*a*, 12*b*, 12*c*, and 12*d* representing the teeth of one quadrant of the mouth and the other players control the set of playing pieces which represents the opposite quadrant of the mouth. Alternatively, one player may control the two sets of tokens 12*c* and 12*d* representing the lower teeth of the mouth, and the other player may control the other two sets of tokens 12*a* and 12*b* representing the upper teeth of the mouth.

In the case of four players, each player would control one set of tokens. In addition, if it is decided to play with partners, the two players controlling tokens representing the upper teeth of the mouth would play against the two players controlling the tokens representing the lower teeth of the mouth.

The object of the game is to be the first to move one's set of numbered and base-colored tokens 12*a*, 12*b*, 12*c*, and 12*d* from their corresponding numbered and colored starting spaces 11*a*, 11*b*, 11*c*, and 11*d* across the playing field and to place them on the corresponding numbered and colored spaces of sets 10*a*, 10*b*, 10*c*, or 10*d*. By doing so, the teeth represented by the tokens will be placed in their exact and proper position. The player who completes this task first wins the game.

In the case of play with partners, the set of partners who first complete the proper positioning of both their sets of tokens on the opposite ridge defined by spaces 10*a* and 10*b*, or 10*c* and 10*d*, according to their number and base color, win the game. When one of the partners has moved his set of tokens to their respective and proper location on the opposite ridge, he then becomes technical adviser and may suggest moves or discuss strategy with his partner on how that partner should move his set of tokens to their respective and proper positions on the opposite ridge, at which point either the upper or lower teeth represented by the tokens would all be in their exact and proper position.

Figure 2:
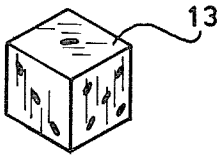
FIG. 2 is a perspective view of a die used with the game board apparatus.
Figure 4:
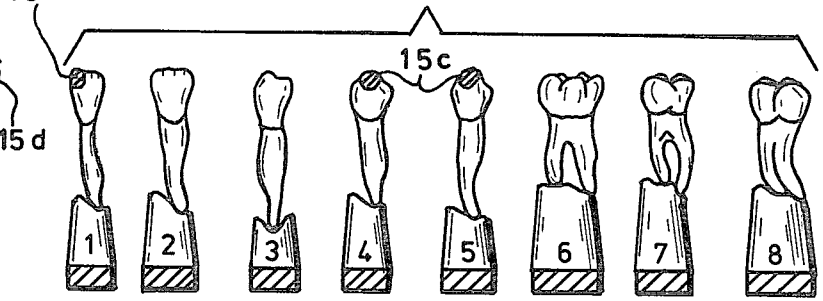
FIGS. 3–6 are side elevational views of the four sets of playing pieces used in association with the game board illustrated in FIG. 1.
Figure 3:
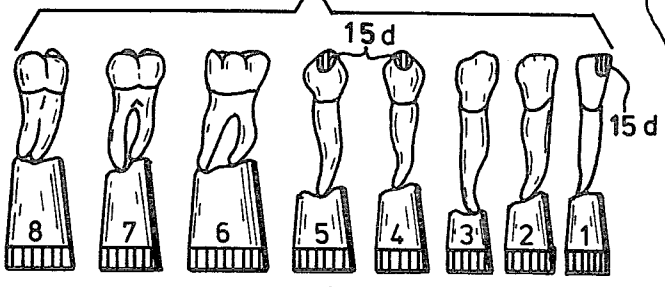
Figure 6:
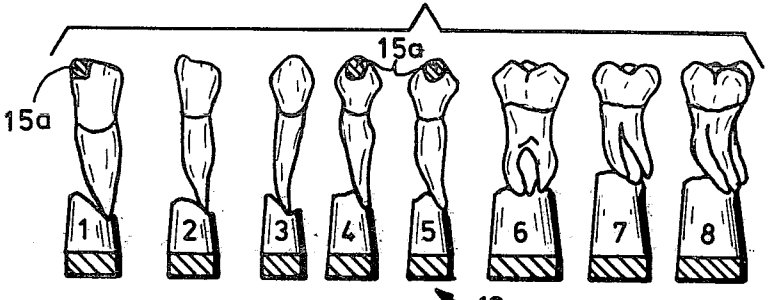
Figure 5:
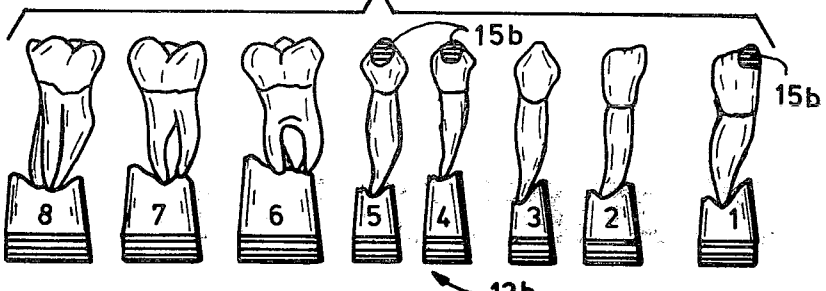

To start the game, each player chooses one set of tokens, 12*a*, 12*b*, 12*c*, or 12*d* and places them according to base-color and number on their corresponding colored and numbered starting space of sets 11*a*, 11*b*, 11*c*, or 11*d*, respectively. As previously mentioned, if there are only two players, each player chooses a set of tokens which represent the teeth of opposite quadrants (i.e., either sets 12*a* and 12*c* or 12*b* and 12*d*) and, if played with partners, one pair of partners will take sets 12*a* and 12*b* or the other pair of partners will take the other two sets 12*c* and 12*d*. Then, it will be randomly determined, such as by a throw of a die 13 (FIG. 2) who will move first. The player with the highest number starts first and play proceeds in a clockwise fashion.

Figure 7:
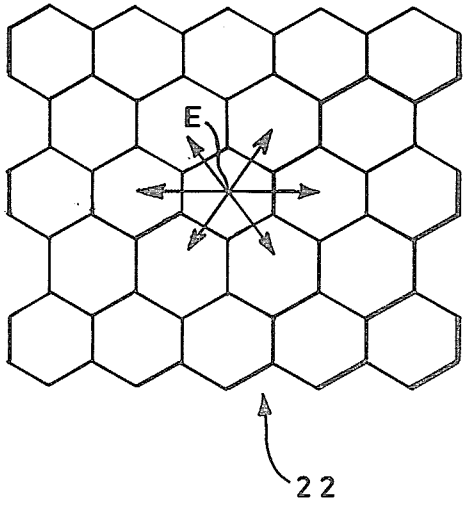
FIG. 7 is a fragmentarily-illustrated section of the board which further depicts by arrows the possible straight line moves of the playing pieces.

The tokens may be moved one at a time in a predefined manner. The tokens numbered 1, which represent the central tooth, have the supreme power and they can be moved up to three spaces only along a straight line in any direction as used herein, a straight line move is a move by token from one hexagonal playing space through a side and at 90° to the side as illustrated by arrows E in FIG. 7 which depict one space straight line moves. These tokens have the power to eject any token occupying the third space in a three space move (except for another numbered 1 token) and to send the ejected token to the correspondingly colored and numbered restarting space of sets 14*a*, 14*b*, 14*c*, or 14*d*, respectively.

Figure 8:
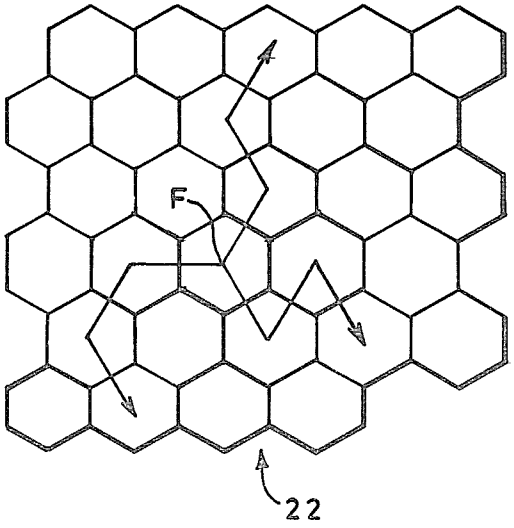
FIG. 8 is a fragmentarily-illustrated section of the board which further depicts by arrows the possible diagonal lines of the playing pieces.

The tokens numbered 4 and 5 and representing respectively the first and second bicuspid teeth have secondary powers. They can be moved up to three spaces on a straight line in any direction from one hexagon to another (FIG. 7) or diagonally from one hexagon to another as illustrated by the arrows F in FIG. 8, which depict three space diagonal moves. They have the power to eject any tooth occupying the third space only as they are moved on a straight line (except for the tokens numbered 1). Power pieces numbered 1, 4 and 5 are each identified with a corresponding colored dot 15 for ready identification. All the other numbered tokens can be moved up to two spaces on a straight line in any direction (FIG. 7) or diagonally (FIG. 8) but have no ejecting powers.

If a token is ejected, it is placed on its corresponding colored and numbered restarting space of the palatal or lingual area (i.e., space of sets 14*a*, 14*b*, 14*c*, or 14*d*). However, if this space is occupied, the token may not be ejected by the other player. The player whose token has been ejected may, on his next turn, at his discretion, move the ejected token from its restarting space.

It should be noted that, once the tokens reach their proper position on the opposite ridge (defined by sets 10*a*, 10*b*, 10*c*, or 10*d*), they cannot be moved thereafter nor ejected by another player. Also, it is not permissable for one token to jump oven another token.

Finally, it should be appreciated that, aside from the entertainment value of the game, the players will become familiar with the anatomy of the mouth and the identification and proper positioning of teeth and thus the game will be of great educational value as well.

While only one embodiment of the present invention has been shown and described, it will be obvious to those persons of ordinary skill in the art that many changes and modifications may be made thereunto without departing from the spirit and scope of the invention.

What is claimed is:

1. A dental board game apparatus for at least two players, comprising:

a random number generator;

a board having a playing field, defined by an array of hexagonal continuous playing spaces, having a generally arch-shaped upper and lower periphery, said upper periphery of which is bounded by two first sets of eight playing spaces, the peripheral arch arrangement of the spaces in said first two sets configured to correspond to the arch arrangement of the upper left and upper right quadrant tooth representations on an open mouth tooth diagram, and said lower periphery of which is bounded by two second sets of eight playing spaces, the peripheral arch arrangement of the spaces in said second two sets configured to correspond to the arch arrangement of the lower left and right quadrant tooth representations on an open mouth tooth diagram;

two first groups of eight playing pieces, the playing pieces of each group of which each represent a specific upper tooth of the upper left and upper right quadrants of the mouth, respectively, and two second groups of eight playing pieces, the playing pieces of each group of which each represent a specific lower tooth of the lower left and right quadrants of the mouth, respectively, each of said playing pieces being initially positionable on a playing space remote from the playing space of said first and second sets which defines the respective location of the tooth which the playing piece represents and which also defines an end space for said playing piece and being thereafter randomly movable along said playing spaces for desired eventual placement on said end playing space;

four discrete groups of eight continuous starting spaces disposed outwardly of the periphery of said playing field, the starting spaces of the first, second, and fourth groups of which each represent a starting space for one of said playing spaces representing a specific tooth in the upper left, upper right, lower left, and lower right quadrants of the mouth, respectively, with at least one of said spaces of said first, second, third, and fourth groups of said starting spaces adjoining at least one of said playing spaces defining the lower right, lower left, upper right, and upper left quadrant of the mouth, respectively;

two third sets of seven playing spaces, the playing spaces of one set of which each adjoin at least one of the playing spaces of one of said first sets of playing spaces which define the upper right quadrant of said upper ridge and the playing spaces of the other set of which each adjoin at least one of the playing spaces of the other of said first sets of playing spaces which define the upper left quadrant of said upper ridge, said two third sets collectively defining the anatomical position of the palatal surface of the mouth, and two fourth sets of seven playing spaces, the playing spaces of one set of which each adjoin at least one of the playing spaces of one of said second sets of playing spaces which define the lower right quadrant of the lower ridge and the playing spaces of the other set of which each adjoin at least one of the playing spaces of the other of said second sets of playing spaces which define the lower left quadrant of the lower ridge, said two fourth sets collectively defining the anatomical position of the lingual surface of the mouth and wherein said playing spaces of said one and said other of said third sets each represent a restarting location for one of said playing pieces of said second groups of playing pieces representing a specific tooth of the lower left and right quadrants of the mouth, respectively, and said playing spaces of said one and said other of said fourth sets each represent a restarting location for one of said playing pieces of said first groups of playing pieces representing the upper left and right quadrant of the mouth, respectively.

2. The apparatus according to claim 1, wherein each of said spaces of said first and second sets have indicia imprinted thereon to signify which tooth they represent and wherein said spaces of said third and fourth sets each have indicia imprinted thereon to signify which anatomical surface of the mouth they represent.

3. The apparatus according to claim 1, wherein said two first and second groups of playing pieces, each comprise eight tokens which are configured to simulate the central, lateral, cuspid, first bicuspid, second bicuspid, first molar, second molar, and third molar teeth of the mouth, respectively, which are mounted on a base colored differently from the bases of the teeth of the other groups.

4. The apparatus according to claim 1, wherein there are a total of 226 spaces.

5. The apparatus according to claim 1, wherein said playing field has a generally hexagonal periphery.

6. The apparatus according to claim 1, wherein said random number generator comprises a die.

7. The apparatus according to claim 1, wherein the sets of starting spaces, restarting spaces, and end spaces associated with a particular group of playing pieces are each colored the same as the bases of the playing pieces of the associated group of playing pieces.

8. The apparatus according to claim 7, wherein each group of playing pieces are numbered 1 to 8, each set of starting spaces are numbered 1 to 8, each set of restarting spaces are numbered 2 to 8, and each set of end spaces are numbered 1 to 8.

* * * * *